US005257694A

United States Patent [19]

Wallach

[11] Patent Number: 5,257,694

[45] Date of Patent: Nov. 2, 1993

[54] RETAIL FLOOR MAT DISPLAY SYSTEM

[75] Inventor: Stewart Wallach, Boca Raton, Fla.

[73] Assignee: Sagaz Industries, Inc., Miami, Fla.

[21] Appl. No.: 976,963

[22] Filed: Nov. 16, 1992

[51] Int. Cl.[5] ..... B65D 85/18

[52] U.S. Cl. ..... 206/286; 206/284; 206/806; 383/39; 383/40

[58] Field of Search ..... 206/282, 284, 286, 287, 206/335, 806; 383/37, 39, 40; 190/109, 111; 223/91, 96

[56] References Cited

U.S. PATENT DOCUMENTS

| | | | |
|---|---|---|---|
| 1,521,897 | 1/1925 | Martin | 383/40 |
| 2,385,053 | 9/1945 | Bohn | 206/286 |
| 2,704,098 | 3/1955 | Pocock | 383/40 |
| 3,834,497 | 9/1974 | Furst | 206/287 |
| 3,841,478 | 10/1974 | Wells et al. | 206/491 |
| 3,862,687 | 1/1975 | Pirman | 206/527 |
| 3,899,078 | 8/1975 | Ambrozetes et al. | 206/491 |
| 4,011,946 | 3/1977 | Savage et al. | 206/284 |
| 4,718,581 | 1/1988 | Chiaramonte | 223/96 |
| 4,759,480 | 7/1988 | Duester et al. | 223/91 |
| 4,856,654 | 8/1989 | Reuben | 206/449 |
| 5,056,930 | 10/1991 | Mestetsky | 383/40 |
| 5,065,864 | 11/1991 | Schmitt | 206/287 |

*Primary Examiner*—David T. Fidei

*Attorney, Agent, or Firm*—Reising, Ethington, Barnard, Perry & Milton

[57] ABSTRACT

A system (10) for displaying four-piece automotive floor mat sets (14, 22). The display system comprises a first envelope (12) with a bottom opening (70) for receiving and covering the two larger front floor mats (14) and a second envelope, or pocket, (20) with a top opening (76) for receiving and holding the smaller rear floor mats (22). The second envelope (20) is piggy-backed on the first envelope (12). A clamp hanger (32) grips the larger pair of floor mats (14) and suspends them from a display bar (40). The remainder of the package (10) suspends from the larger floor mats (14). The envelopes (12, 20) comprise transparent plastic.

15 Claims, 3 Drawing Sheets

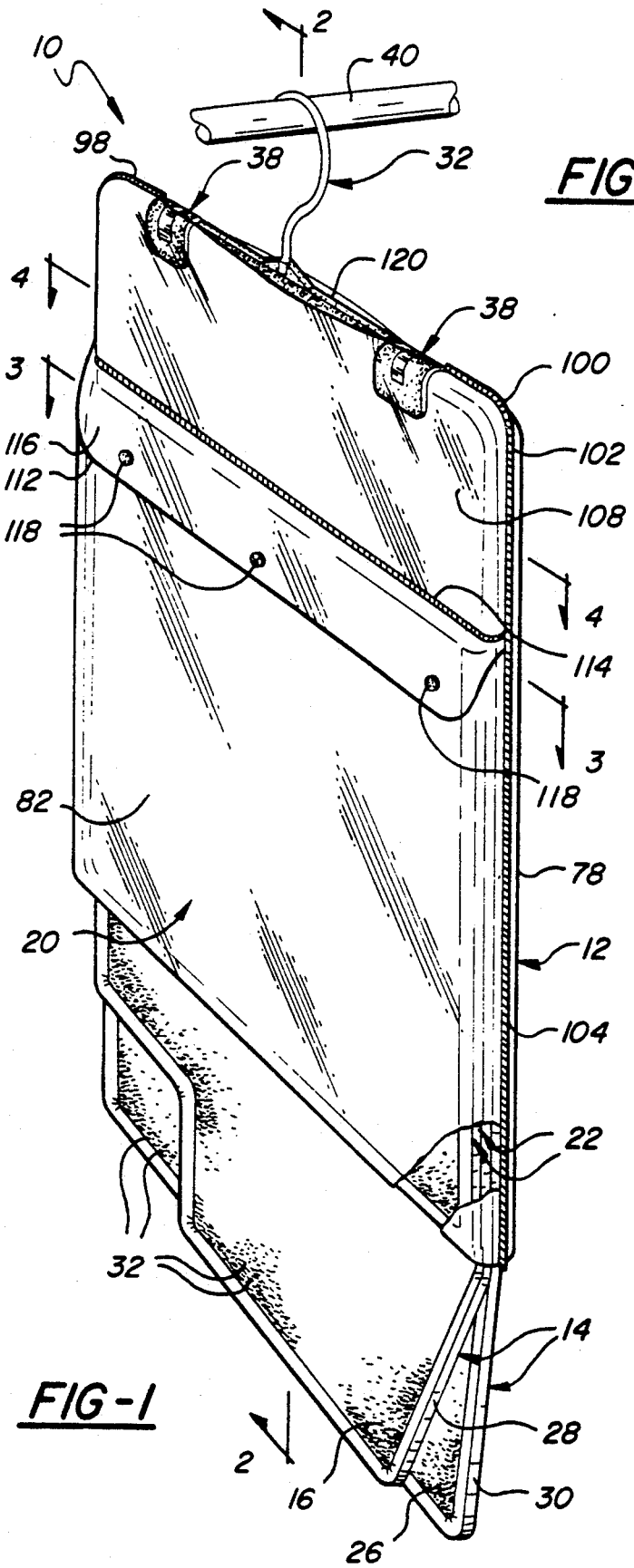
FIG-1
FIG-2
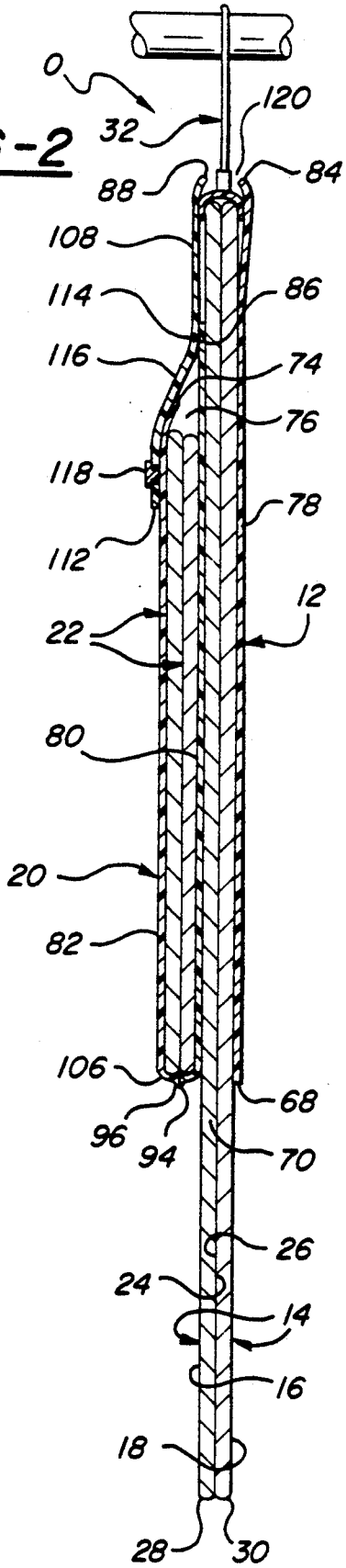

RETAIL FLOOR MAT DISPLAY SYSTEM

TECHNICAL FIELD

This invention relates to packaging systems for displaying automobile floor mats.

BACKGROUND ART

Automotive floor mat manufacturers need effective ways to package and market their products. One important measure of an effective floor mat display is its ability to hold the floor mats together and protect them in shipping and handling. Another important measure is the package's ability to display the mats and their main selling features to retail customers.

Currently, floor mat manufacturers use staples to join floor mat sets. Staples are difficult to remove and damage the mats they penetrate.

For example, U.S. Pat. No. 4,856,654 to Reuben, issued Aug. 15, 1989, discloses a system for displaying two-mat sets. The packaging system includes a hanger for suspending the floor mat package from a display bar. A single pouch is attached alongside the floor mats for holding certain accompanying fastening components. Staples penetrate the mats, the pouch, and the hanger. The staples serve to hold the mats, pouch and hanger together but also damage the mats. The staples must be forcibly extracted using tools such as pliers, or a screwdriver. In addition, this system is unable to handle four-piece floor mat sets since staples will not penetrate a stack of four mats.

SUMMARY OF THE INVENTION AND ADVANTAGES

A display package for displaying fourpiece automotive floor mat sets. The display package comprises a first envelope and a first pair of floor mats disposed in a layered disposition within the first envelope. A second envelope, or pocket, is piggy-backed on the first envelope and a second pair of floor mats is disposed in a layered disposition within the second envelope. The display package is characterized by clamping means having opposing clamping surfaces for bracketing the first pair of mats and exerting generally opposing forces perpendicular to the outside surfaces of the first pair of floor mats. The opposing forces increase the friction between the first pair of floor mats and also between the clamping surfaces and the first pair of floor mats' outside surfaces. The increased friction secures the first pair of floor mats in relation to each other and in relation to the clamping means without penetrating the first pair of floor mats.

This system uses the compressive force of the clamping means to hold the first pair of floor mats together and to connect the package to its hanger for display. There are no staples to remove and no perforation damage to the floor mats. The clamping means therefore suspend and display the first pair and second pair of floor mats in a generally vertical orientation.

BRIEF DESCRIPTION OF THE DRAWINGS

To better understand and appreciate the advantages of this invention, refer to the following detailed description in connection with the accompanying drawings:

FIG. 1 is a rear, partially broken-away, perspective view of the retail floor mat display system including four floor mats disposed inside two adjacent envelopes;

FIG. 2 is a cross-sectional side view taken substantially along lines 2—2 of FIG. 1;

DETAILED DESCRIPTION OF THE PREFERRED EMBODIMENT

Figure 3:
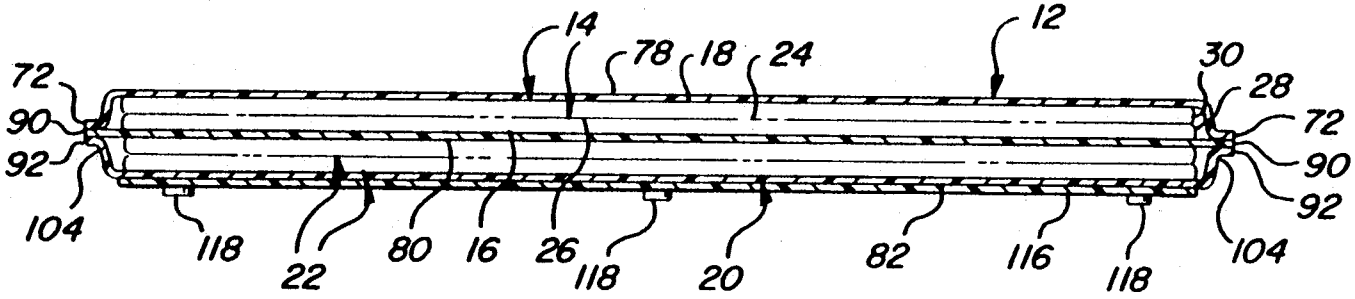
FIG. 3 is a cross-sectional view taken substantially along lines 3—3 of FIG. 1.
Figure 4:
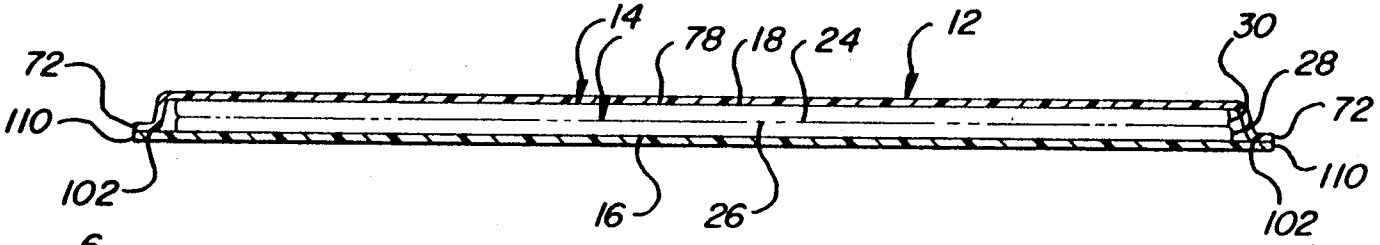
FIG. 4 is a cross-sectional view taken substantially along lines 4—4 of FIG. 1.

A system for displaying a four-piece automotive floor mat set is generally shown at 10 in FIGS. 1 and 2. The display package 10 comprises a first envelope generally indicated at 12 with a first pair of large floor mats each of which is generally indicated at 14, disposed in a layered disposition within the first envelope 12 The first pair of floor mats 14 have outside surfaces 16, 18. A second envelope, or pocket, generally indicated at 20 is piggy-backed on the first envelope 12. A second pair of floor mats each of which is generally indicated at 22, is disposed in a layered disposition within the pocket 20. The mats 22 of the second pair are smaller than the mats 14 of the first pair. The first pair of mats 14 are for the front of a vehicle and the second pair of mats 22 are for the smaller area between the front and rear seats of a vehicle.

Each of the first pair of mats 14 has a front surface 18 and 24, respectively. Each of the mats 14 has a back surface 16 and 26, respectively. Each of the mats 14 has a perimeter edge 28 and 30, respectively. The front surfaces 18, 24 comprise low-pile carpet. The back surfaces 16, 26 comprise rubber or plastic surfaces which incorporate thousands of small nubs 32, with approximately ten nubs 32 per square inch of surface. The rubber nubs 32 are integrally joined to the rubber back surfaces 16, 26 of the first pair of mats 14. The rubber nubs 32 are roughly conical in shape with rounded tips. The perimeter edges 28, 30 comprise a serged binding. The first pair of mats 14 are cut and tapered to conform to the approximate dimensions of the front passenger compartment floor of a passenger vehicle. The second pair of mats 22 are identical to the first pair of mats 14 except that the second pair of mats 22 are shorter than the first pair of mats 14 and are rectangular in shape.

Figure 7:
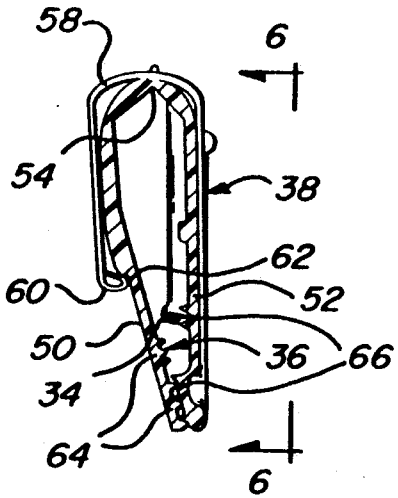
FIG. 7 is a cross-sectional view taken substantially along line 7—7 of FIG. 6.
Figure 6:
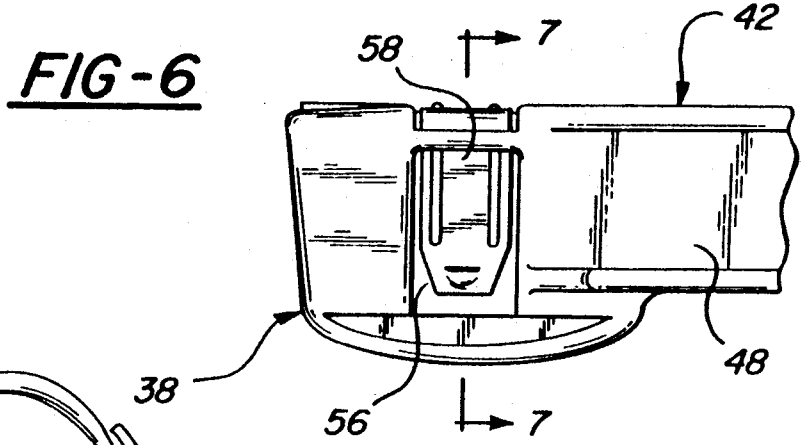
FIG. 6 is a fragmentary rear view taken substantially along line 6—6 of FIG. 7.
Figure 5:
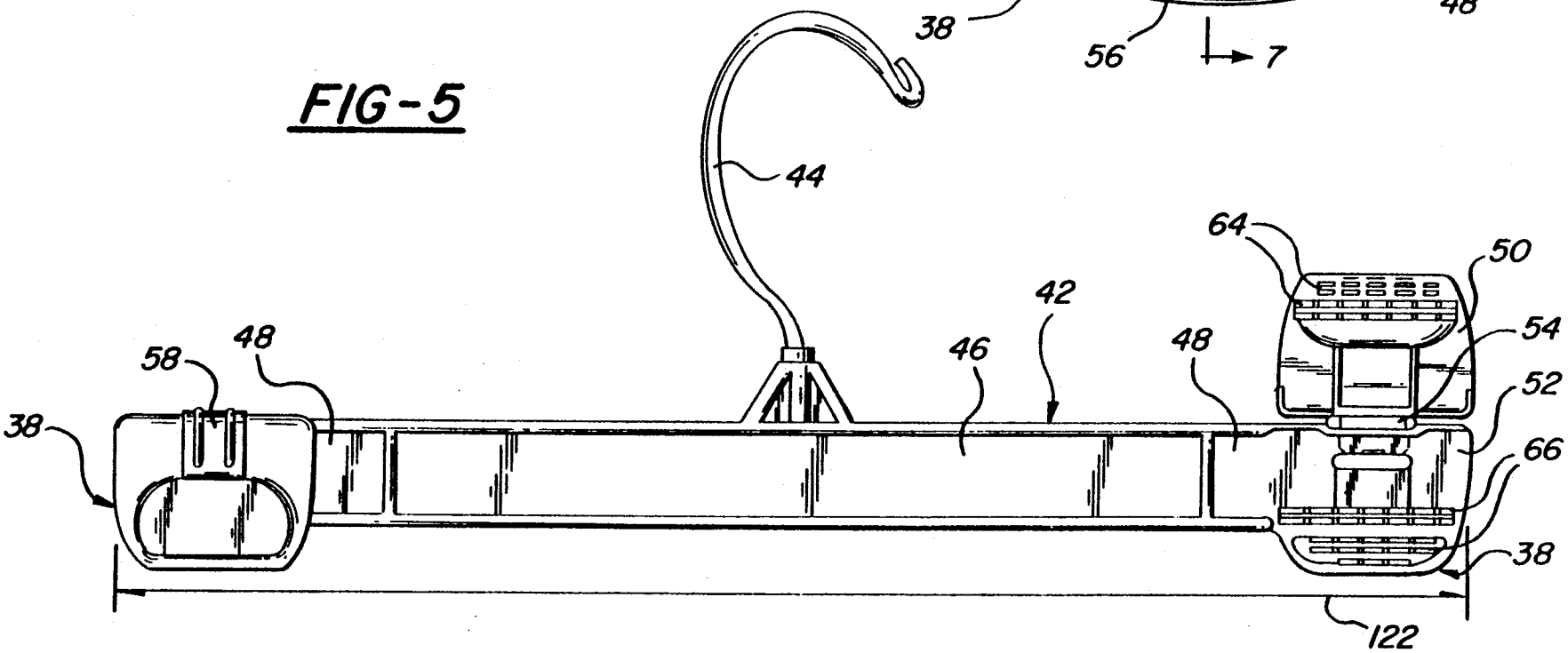
FIG. 5 is a side view of the clamp hanger with one plastic clamp open and the other plastic clamp closed.

A clamping means generally indicated at 32 in FIGS. 1 and 2, and generally shown at 32 in FIG. 5 is for displaying the first and second pair of floor mats 14, 22 in a generally vertical orientation. The clamping means 32 has opposing clamping surfaces generally indicated at 34 and 36 in FIG. 7 which bracket the first pair of mats 14 and exert generally opposing forces perpendicular to the outside surfaces 16, 18 of the first pair of mats 14. The clamping surfaces 34, 36 are disposed within each of two clamps generally indicated at 38 in FIG. 5. The generally opposing forces increase the friction between the inner surfaces 24, 26 of the first pair of mats 14 and also between the clamping surfaces 34, 36 and the outside surfaces 16, 18 of the first two floor mats 14. This secures the first pair of floor mats 14 in relation to each other and in relation to the clamping means 32 without penetrating the first pair of mats 14. The nubs 32 on the back surface 26 of the front mat of the first pair of mats 14 embed in the carpet pile on the front surface 24 of the back mat of the first pair of mats 14 increasing the friction effect the clamping means 32 creates. The clamping means 32 thereby suspends both pairs of mats 14, 22, in a generally vertical orientation, from a display bar 40.

The clamping means 32 comprises a clamping hanger including a plastic shoulder bar generally indicated at 42 and a metal hook 44 rotatably connected to the shoulder bar 42 midway along the length of the shoulder bar 42, and the pair of clamps 38 disposed at opposite ends of the shoulder bar 42. The shoulder bar 42 comprises an elongated I-beam 46 including ends 48 integrally merging into the clamps 38. The clamps 38 each form the approximate shape of open clamshells having upper and lower shell portions 50, 52 hinged at their interfaces. The lower shell portions 52 are fixed relative to the I-beam 46. The upper shell portions 50 pivot downwardly about hinges 54 at the interfaces between the upper shells 50 and lower shells 52. The hinges 54 comprise narrowed portions of plastic adjacent the top edge of the shoulder bar 42. In other words, the narrowed portions serve as "living hinge" type clamp hinges. The exterior of each plastic clamp 38 includes rectangular channels 56. Mounted in these channels 56 are metal U-clips 58, one U-clip 58 on each plastic clamp 38. The U-clips 58 comprise flat, elongated, metal strips bent into U-shapes and curled at the lower-front ends 60. The channels 56 are slightly wider than the U-clips 58 and hold the U-clips 58 in position while accommodating vertical sliding motion of the U-clips 58. On the outer surface of the clamps 38 are ledges, or "drop-offs" 62 which engage and retain the curled portions 60 of each U-clip 58 at the limit of their downward travel.

When pushed downward, the U-clips 58 releasably force the plastic clamps 38 into a closed, clamped position around the first pair of mats 14. The clamping surfaces 34, 36 within the plastic clamps 38 comprise two double rows, each, of tooth-like protrusions 64, 66 extending outwardly from the inner clamping surfaces 34, 36 of the plastic clamps 38. The tooth-like protrusions 64, 66 engage the nubs 32 on the back surface 16 of the back mat in the first pair of floor mats 14, and also engage the front surface 18 of the front mat in the first pair of floor mats 14. The engagement of the protrusions 64, 66 with the nubs 32 and the front surface 18 increases the friction resulting from the compression from the clamps 38. The combination of all the friction forces effectively prevents external torsion and shear forces, i.e. those forces resulting from gravity and normal consumer handling and inspection, from disengaging the first pair of mats 14 from the clamping hanger 32.

The first envelope 12 has a bottom edge 68 and a first access opening 70 disposed adjacent the bottom edge 68 to receive the first pair of mats 14 from below. The first envelope also has side edges 72. The pocket 20 has a top edge 74 and a second access opening 76 disposed adjacent the top edge 74 to receive the second pair of mats 22 from above.

The second envelope, or pocket, 20 encloses a smaller volume than the first envelope 12 since the pocket 20 encloses the smaller rear mats 22 of a passenger vehicle. The pocket 20 is disposed flush with the bottom edge 68 of the first envelope 12. The pocket 20 is also disposed adjacent the side edges 72 of the first envelope 12. The overall length of the display package 10 is such as to allow approximately one third of the length of the first pair of mats 14 to protrude through the first access opening 70.

The first envelope comprises a rectangular front panel 78 and a middle panel 80. The second envelope, or pocket, comprises a middle panel 80 in common with the first envelope and a back panel 82. The front panel 78 is rectangular with rounded top corners. The middle 80 and back panels 82 are rectangular. The panels 78, 80, 82 each have respective top edges 84, 86, 74, a pair of side edges 72, 90, 92 and bottom edges 68, 94, 96. The panels 78, 80, 82 are bonded together along at least two edges and forming common seams 98, 100, 102, 104, 106. More specifically, the front panel 78, middle panel 80 and back panel 82 are bonded along the length of the side edges 90 of the middle panel 80 forming common lower side seams 104. The middle panel 80 and the back panel 82 are bonded along the length of their respective bottom edges 94, 96 forming a common bottom seam 106.

An upper back panel 108 has a top edge 88 a pair of side edges 110, and a bottom edge 112. The upper back panel 108 extends from the top edge 86 of the middle panel 80 upwardly to the top edge 84 of the front panel 78. The top edge 88 of the upper back panel 108 is bonded to the top edge 84 of the front panel 78 forming a common top seam 98, 100 The side edges 110 of the upper back panel 108 are bonded to the side edges 72 of the front panel 78 forming common upper side seams 102. The bottom edge 112 of the upper back panel 108 is bonded to the top edge 86 of the middle panel 80 forming a common middle seam 114.

A flap 116 is disposed adjacent the second access opening 76 and includes fastening means 118 for releasably joining the flap 116 to the back panel 82. The flap 116 is an elongated rectangle with rounded lower corners. The length of the flap 116 is the same as the width of the back panel 82 and the upper back panel 108. The width of the flap 116 is sufficient to extend across the second access opening 76. The flap 116 is long enough to cover the second access opening 76 and then overlap the back panel 82. The overlapping portion of flap 116 includes the fastening means 118. The fastening means 118 comprises three plastic snaps spaced evenly along the length of the flap 116.

In the preferred embodiment depicted in FIGS. 1, 2, 3 and 4, the upper back panel 108 and the flap 116 comprise a single panel with the flap 116 extending downwardly from the common middle seam 114. In this preferred embodiment the upper back panel 108 extends from the top edge 84 of the front panel 78 downwardly to a point where it bonds with the top edge 86 of the middle panel 80 then down another approximate two inches, forming a flap 116 over the upper access opening 76 of the pocket 20. The upper back panel 108 is bonded to the top edge 86 of the middle panel 80 forming a common middle seam 114 approximately two inches above, and parallel to the bottom edge 112 of the upper back panel 108. In other words, the flap 116 extends downwardly from the common middle seam 114 and extends over the second access opening 76.

The panels 78, 80, 82, 108 and flap 116 comprise thin transparent plastic of approximately 8 microns in thickness.

The first envelope 12 includes a top opening 120. The shoulder bar 42 of the clamping hanger 32 has a span 122. The hook 44 on the clamping hanger 32 extends upwardly through the top opening 120 of the first envelope 12. The top opening 120 is less than one span 122 in length. In other words, the length of the top opening 120 is less than the length of the shoulder bar 42 of the clamping hanger 32. The top opening 120 is narrow, elongated and rectangular in shape. The top opening 120 is cut from the upper back panel 108 and runs parallel to and adjacent the top edge 84 of the front panel 78.

The common seams 98, 100, 102, 114, 104, 106 can be heat-fused, crimped interfaces or other suitable type of bonded interfaces. All common seams with the exception of the common middle seam 114 protrude outwardly. The edges that join at the common middle seam 114 are opposing and overlapping.

Therefore, the first envelope 12 is open at the top and bottom and is hung vertically by the clamping means 32 forcibly engaging the first pair of mats 14 covered by the first envelope 12. A pair of smaller mats 22 is disposed in a pocket 20, having a closed bottom, on the side of the first envelope 12.

This is an illustrative description of the invention using words of description rather than limitation.

Obviously, many modifications and variations of this invention are possible in light of the above teachings. Within the scope of the claims, where reference numerals are merely for convenience and are not limiting, one may practice the invention other than as this specification describes.

I claim:

1. A system (10) for displaying a four-piece automotive floor mat set (14,22), said display system comprising: a first envelope (12) and a first pair of floor mats (14) disposed in a layered disposition within said first envelope (12) said first pair of floor mats (14) having outside surfaces (16, 18); a second envelope (20) and a second pair of floor mats (22) disposed in a layered disposition within said second envelope (20); characterized by clamping means (32) for displaying said first pair of floor mats (14) in a generally vertical orientation, said clamping means (32) having opposing clamping surfaces (34, 36) for bracketing said first pair of mats (14) and exerting generally opposing forces perpendicular to said outside surfaces (16, 18) of said first pair of floor mats (14) to increase the friction between said first pair of floor mats (14) and also between said clamping surfaces (34, 36) and said outside surfaces (16, 18) of said first two floor mats (14) to secure said first pair of floor mats (14) in relation to each other and in relation to said clamping means (32) without penetrating said first pair of floor mats (14); and attaching means (74, 92, 96) for attaching said second envelope (20) to said first envelope (12) independent of said opposing forces of said clamping means (32).

2. A display package (10) as set forth in claim 1 further characterized by said first envelope (12) having a bottom edge (68) and a first access opening (70) disposed adjacent said bottom edge (68) to receive said first pair of floor mats (14) from below.

3. A display package (10) as set forth in claim 2 further characterized by said second envelope (20) having a top edge (74) and a second access opening (76) disposed adjacent said top edge (74) to receive said second set of floor mats (22) from above.

4. A display package (10) as set forth in claim 1 further characterized by first envelope comprising a front panel (78) and a middle panel (80) and said second envelope comprising a middle panel (80) in common with said first envelope and a back panel (82), said panels (78, 80, 82) each having respective top edges (84, 86, 74), a pair of side edges (72, 90, 92) and bottom edges (68, 94, 76), said panels (78, 80, 82) bonded together at least two edges and forming common seams (98, 100, 114, 104, 106).

5. A display package (10) as set forth in claim 4 further characterized by said first envelope (12) including a top opening (120) and by said clamping means (32) comprising a clamping hanger (32) having a hook (44) and a shoulder bar (42) disposed perpendicular to said hook (44) and said shoulder bar (42) having a span (122), said hook (44) extending upwardly through said top opening (120), said top opening (120) being less than one span (122) in length.

6. A display package (10) as set forth in claim 3 further characterized by a flap (116) adjacent said second access opening (76) and fastening means (118) for releasably joining said flap (116) to said back panel (82).

7. A display package (10) as set forth in claim 6 further characterized by said fastening means (118) comprising a plastic snap.

8. A display package (10) as set forth in claim 5 further characterized by said second envelope (20) enclosing a smaller volume than said first envelope (12), said second envelope (20) for enclosing the smaller rear floor mats (22) of a passenger vehicle.

9. A display package (10) as set forth in claim 8 further characterized by said smaller second envelope (20) disposed flush with said bottom edge (68) of said first envelope (12).

10. A display package (10) as set forth in claim 9 further characterized by an upper back panel (108), said upper back panel (108) having a top edge (88) a pair of side edges (110) and a bottom edge (112), said upper back panel (108) extending from said top edge (86), of said middle panel (80) upwardly to said top edge (84) of said front panel (78) with said top edge (88) of upper back panel (108) bonded to said top edge (84) of said front panel (78) forming a common top seam (98, 100) and said side edges (110) of said upper back panel (108) bonded to said side edges (72) of said front panel (78) forming common upper side seams (102) and said bottom edge (112) of said upper back panel (108) bonded to said top edge (86) of said middle panel (80) forming a common middle seam (114).

11. A display package (10) as set forth in claim 10 further characterized by said upper back panel (108) and said flap (116) comprising a single panel, said flap (116) extending downwardly from said common middle seam (114).

12. A display package (10) as set forth in claim 11 further characterized by said panels (78, 80, 82, 108) comprising a plastic material.

13. A display package (10) as set forth in claim 12 further characterized by said panels (78, 80, 82, 108) comprising a transparent material.

14. A display package (10) as set forth in claim 13 further characterized by said common seams (98, 100, 102, 114, 104, 106) comprising heat-fused interfaces.

15. A display package (10) as set forth in claim 13 further characterized by said common seams (98, 100, 102, 114, 104, 106) comprising glued interfaces.

* * * * *